US009340061B2

(12) United States Patent
Rolion et al.

(10) Patent No.: US 9,340,061 B2
(45) Date of Patent: May 17, 2016

(54) LEAD HOLDER HAVING A SLIDABLE PUSH MEMBER

(71) Applicant: Societe BIC, Clichy (FR)

(72) Inventors: Franck Rolion, Asnieres sur Oise (FR); Ludovic Fagu, Noisy le Sec (FR)

(73) Assignee: SOCIÉTÉ BIC, Clichy (FR)

( * ) Notice: Subject to any disclaimer, the term of this patent is extended or adjusted under 35 U.S.C. 154(b) by 0 days.

(21) Appl. No.: 14/385,206

(22) PCT Filed: Mar. 1, 2013

(86) PCT No.: PCT/FR2013/050435

§ 371 (c)(1),
(2) Date: Sep. 15, 2014

(87) PCT Pub. No.: WO2013/135989

PCT Pub. Date: Sep. 19, 2013

(65) Prior Publication Data

US 2015/0043956 A1 Feb. 12, 2015

(30) Foreign Application Priority Data

Mar. 16, 2012 (FR) ..... 12 52418

(51) Int. Cl.

| | |
|---|---|
| ***B43K 24/04*** | (2006.01) |
| ***B43K 21/00*** | (2006.01) |
| ***B43K 21/16*** | (2006.01) |
| ***B43K 21/22*** | (2006.01) |
| ***B43K 25/02*** | (2006.01) |
| ***B43K 29/02*** | (2006.01) |
| ***B43K 21/06*** | (2006.01) |
| ***B43K 21/18*** | (2006.01) |

(52) U.S. Cl.

CPC ..... *B43K 24/04* (2013.01); *B43K 21/006* (2013.01); *B43K 21/06* (2013.01); *B43K 21/16* (2013.01); *B43K 21/18* (2013.01); *B43K 21/22* (2013.01); *B43K 25/02* (2013.01); *B43K 29/02* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,619,539 | A | 10/1986 | Kageyama | |
| 5,354,141 | A | 10/1994 | Watanabe | |
| 6,517,272 | B1 * | 2/2003 | Kageyama | B43K 29/02 401/67 |
| 2002/0031393 | A1 | 3/2002 | Saito | |

FOREIGN PATENT DOCUMENTS

| | | |
|---|---|---|
| FR | 2 566 707 | 5/1985 |
| WO | WO 2010/037954 | 4/2010 |
| WO | WO 2011/067912 | 6/2011 |

* cited by examiner

*Primary Examiner* — David Walczak
(74) *Attorney, Agent, or Firm* — Polsinelli

(57) ABSTRACT

A mechanical pencil having a tubular body extending along a longitudinal axis between a rear-end which has a first opening and a front-end which has a second opening, a lead that can move out through the second opening and a mechanism for advancing the lead arranged within the tubular body. The advancing mechanism includes a pushing device adapted to slide parallel to the longitudinal axis, a chuck located at the front end side of the tubular body and which could be tightened onto the lead in a tightened position; a reservoir which extends along the longitudinal axis for housing at least one lead, wherein the tubular body has an annular wall for pushing device retention at the rear end thereof.

10 Claims, 4 Drawing Sheets

FIG. 1
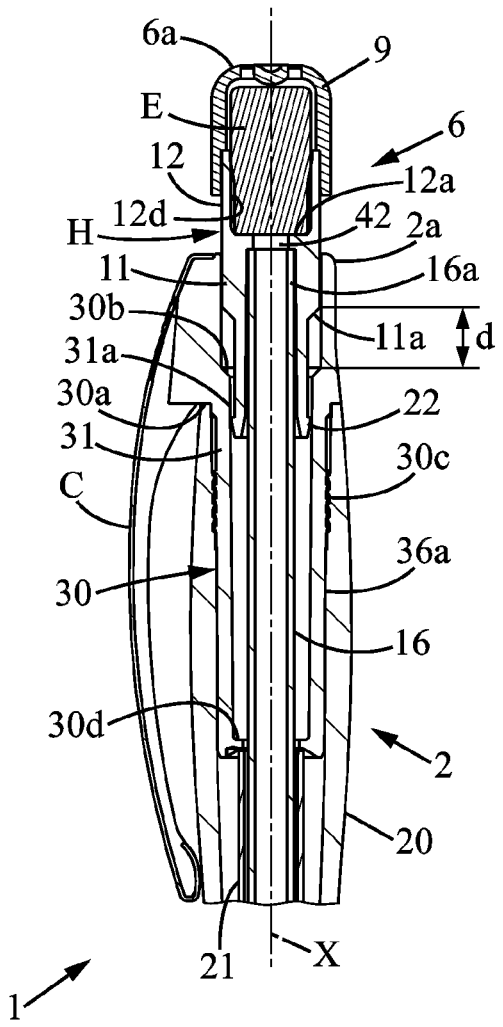
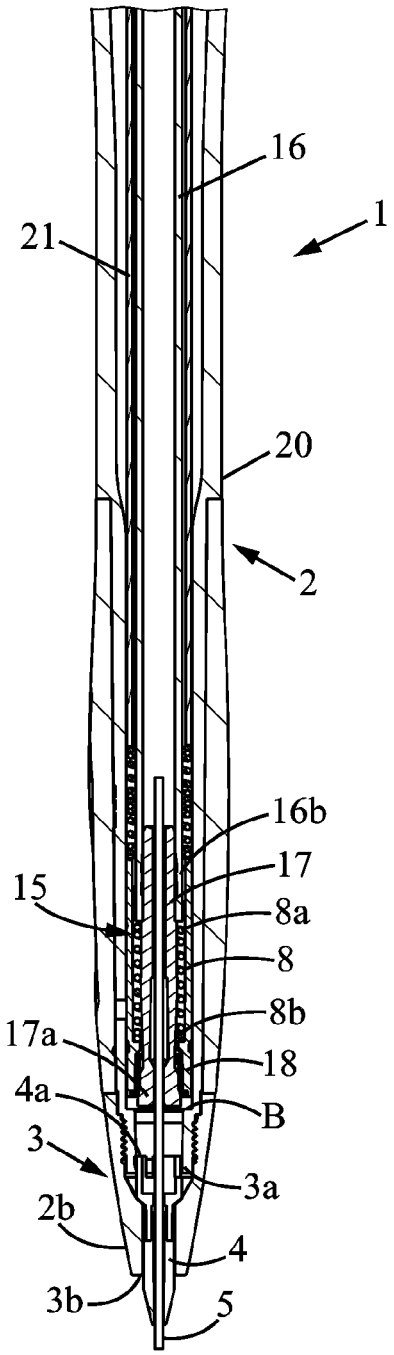
FIG. 2

FIG. 6
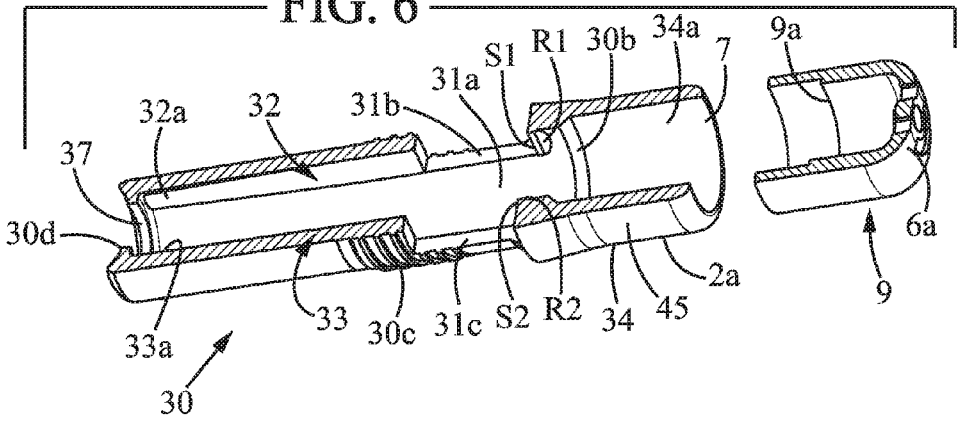
FIG. 7A
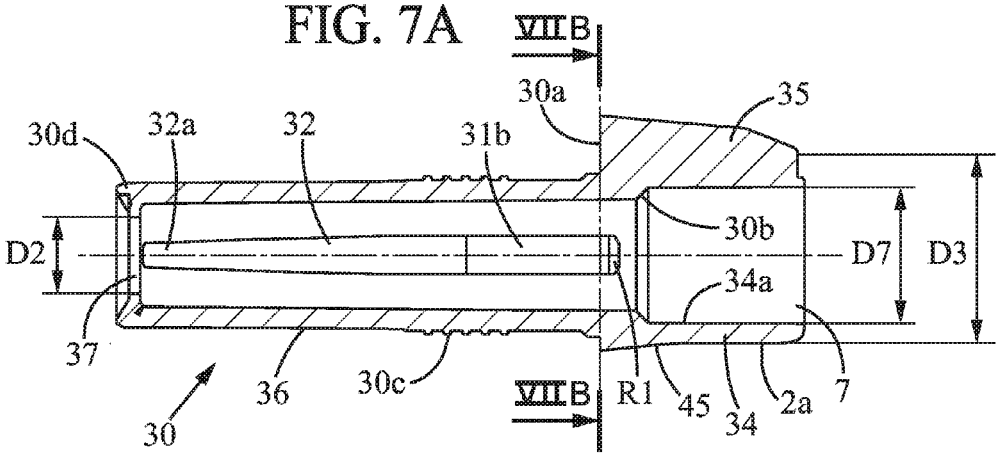
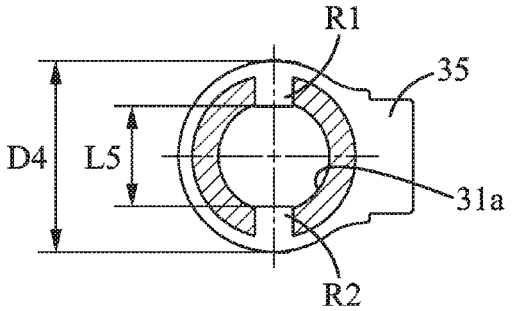
FIG. 7B

LEAD HOLDER HAVING A SLIDABLE PUSH MEMBER

CROSS REFERENCE TO RELATED APPLICATIONS

This application is a national stage application of International Application No. PCT/FR2013/050435, filed on Mar. 1, 2013, which claims the benefit of French Patent Application No. 1252418, filed on Mar. 16, 2012, the entire contents of both applications being incorporated herein by reference.

BACKGROUND OF THE INVENTION

1. Field of the Invention

The embodiments of the present invention relate to a mechanical pencil and more specifically to a mechanical pencil comprising a tubular body extending along a longitudinal axis between a rear-end which has a first opening and a front-end which has a second opening through which a lead can move out and a mechanism for advancing the lead arranged within the tubular body, where the advancing mechanism comprises:

- a pushing device suited for sliding parallel to the longitudinal axis and including an external portion which extends outward relative to the tubular body and an inner portion inserted into the tubular body through the first opening.
- a chuck located at the front end side of the tubular body and which could be tightened onto the lead;
- a reservoir which extends along the longitudinal axis for housing at least one lead, where the reservoir comprises a rear end surrounded by the internal portion of the pushing device and a front end suited for moving the chuck when the pushing device slides towards the front end.

2. Description of Related Art

A mechanical pencil of the aforementioned kind compensates for the wear at the front end of the lead by sliding it relative to the tubular body in response to an axial pressure on the pushing device where the tightening chuck then locks the new position taken by the lead in a well-known manner. During an operation for reloading a lead into the reservoir, the user must simply slide the lead through a central opening, generally narrower than the reservoir, conventionally formed in the pushing device. A removable eraser is generally mounted on the pushing device and covers this central opening in the mechanical pencil's operating configuration.

As an example, the document U.S. Pat. No. 5,354,141 or its equivalent WO 92/15462

A1 disclose a mechanical pencil which includes a pushing device formed from the eraser support and the eraser cap, with a possible eraser-cover, and slidably mounted in a cylindrical barrel. The actuation of the advancing mechanism and the erasing can be done easily with this type of pushing device.

The inside portion of the pushing device can engage with a reservoir whose diameter is reduced compared to the inside diameter of the tubular body. The thrust serves to stop axially on an annular rim at the rear end of the reservoir in order to drive the reservoir forward. The fact of having a reservoir that is significantly narrower than the tubular body is advantageous for getting an easier and faster centering of a new lead in the gripping area of the advancing mechanism.

In the mechanical pencil described in this document, the inner portion of the pushing device includes an elastically deformable thinning portion provided with one or several projecting tabs which engage with an inner shoulder or a window of the barrel in order to form a stop retaining the pushing device. However, a drawback related to the flexibility of the inner portion of the pushing device is that it is easier to break the deformable part of this inner portion, for example during assembly or when a significant force is exerted on the pushing device (for example during energetic erasing). There is then a risk of the pushing device becoming detached from the barrel and lost.

SUMMARY OF THE INVENTION

A purpose of the embodiments of the present invention is to provide a mechanical pencil which reduces the risk of breakage in the pushing device and which preferentially provides the user comfortable handling.

For this purpose, the mechanical pencil according to the embodiments of the invention has an annular wall for pushing device retention at the rear end thereof, where this annular wall has an inner surface with two longitudinal recesses, preferably two slits each with the rear edge thereof delimited by a tab projecting radially inward relative to the remainder of the inner surface of said annular portion, where the inner portion of the pushing device comprises a tubular wall having:

- an inner surface for attaching the rear end of the reservoir (such that the reservoir moves rigidly with the forward and backward motions of the pushing device); and
- an outer surface on which at least one projection projects radially outward, where said projection is located in front of said tabs and suited for stopping against said tabs where because of this the inner portion of the pushing device is retained inside the tubular body.

The functions of support with gripping of the rear end of the reservoir and stopping against the tabs of the tubular body in the area of an inner portion of the pushing device can thereby be combined without using a fragile mobile part. The insertion of the pushing device in the tubular body remains easy considering that tabs are spaced apart and arranged on a minority part of the periphery of the annular retaining portion. Because of these arrangements, the more rigid pushing device is particularly robust and cannot be withdrawn, even accidentally.

It should be noted that, because of the gripping of the rear end of the reservoir directly on the pushing device, the reservoir can be brought closer to the reservoir access passage formed in the pushing device, such that this passage can have the same diameter as the reservoir. Thus, the user can insert replacement leads in the reservoir more easily than with a pushing device that is not in contact with the reservoir (and for which the insertion of leads is necessarily more delicate).

According to a particularity, the longitudinal recesses include two diametrically opposed slits where at least one of the two slits opens radially inward through a rib whose rear end is defined by one of the tabs and where the rib extends substantially parallel to the longitudinal axis from the tab to a front end. It is understood that using flexible zones for achieving latching can be avoided by the fact of making each of the two tabs by a recess in a rib. The projecting projection on the inner portion of the pushing device can thus have very little flexibility (the insertion of the inner portion can be done by light compression of the projection and of the two tabs at the time of latching, with preference given to the use of beveled surfaces to make assembly from the rear easier).

According to a particularity, the rear end of the reservoir is in contact with the longitudinal ribs formed on the inner surface of the tubular wall. The use of ribs makes the insertion of this rear end into the inner portion easier and the reservoir can more easily reach the bottom of the insertion cavity.

According to another particularity, the pushing device comprises an eraser support made of a piece for housing an eraser where the eraser support comprises:

the inner portion;

a mounting member comprising a bottom and a wall extending substantially annularly around the longitudinal axis from the bottom to a rear opening so as to define a cavity for housing the eraser where the mounting member extends the inner portion and makes part of the outer portion; and a passage orifice traversing the bottom of the mounting member and opening directly into the reservoir (it is thus easy to refill the reservoir).

In various embodiments of the mechanical pencil according to the invention one and/or the other of the following dispositions could furthermore be used:

the tubular wall of the inner portion has an axial opening opposite the bottom of the mounting member and delimits a cavity for receiving the rear end of the reservoir between said bottom and the axial opening, where the cavity widens near this axial opening;

the tubular wall of the inner portion has an outer shoulder made away from the projection (with this arrangement of the outer shoulder in the area of the inner portion, accidentally pinching a finger of the user can be avoided and the sliding of the pushing device towards the front can thus be blocked after a range which is sufficient for advancing the lead);

the projection is an annular rib which extends continuously from the inner portion on the circumference of the tubular wall (with this arrangement, the radial compression of the inner portion is minimized and the retention of the pushing device is particularly effective; furthermore the play between the rear end of the body and the pushing device can be greatly reduced with this configuration, which limits the risk of blocking by an external particle (e.g. grain of sand));

the tubular body comprises a barrel (tubular) extending longitudinally around the longitudinal axis and having a length much greater than the length of the pushing device, and also a removable clip support arranged in the extension of the barrel and including the annular retaining wall including the tabs, where the pushing device is slidably mounted in the clip support (this way the clip support which forms the rear end of the tubular body can be removed in order to fill as needed the reservoir which remains rigidly connected with the barrel, and this can be done without interfering with the mounting of the pushing device or the mounting of an eraser);

the clip support includes a rear segment arranged in the axial extension of the barrel and suited for receiving a clip, and a front segment of generally tubular shape extending around the longitudinal axis and which is inserted coaxially into the barrel, where the front segment includes a tubular portion for attachment to the barrel provided with external threading and extending around and away from the reservoir;

the front segment furthermore comprises a terminal portion of generally annular shape arranged in the extension of the tubular attachment portion, where the terminal portion has an annular edge in contact with a covering tube arranged around the reservoir and an axial orifice having an inner diameter at least 30% less than an inner diameter of the first opening;

the clip support includes an outer shoulder in contact with a rear edge of the barrel and an inner shoulder which is axially across from an outer shoulder formed on the tubular wall of the pushing device; the inner shoulder can form a stop or complete a system for stopping forward sliding of the pushing device (because of an inside arrangement of the outer shoulder of the pushing device, the risk of blocking sliding by an external element becoming attached on the rear end of the body can be eliminated);

the longitudinal slits or hollows of the annular retention wall form clip support windows, where the outer shoulder of the clip support is located axially between the windows and the inner shoulder and closer to the window than to said inner shoulder;

the windows or recesses extend longitudinally over a distance which is greater than the distance between the inner shoulder of the clip support and the outer shoulder formed on the tubular wall of the pushing device.

BRIEF DESCRIPTION OF THE DRAWINGS

Other features and advantages of the invention will become apparent during the following description of one of the embodiments thereof, given as a non limiting example, with reference to the attached drawings in which:

FIG. 1 and FIG. 2 are longitudinal sectional views of respectively the rear portion and the front portion of the mechanical pencil according to the invention with the pushing device in a resting position;

FIG. 6 shows two elements of the mechanical pencil from FIG. 1 in perspective and section view;

FIG. 7A is a longitudinal section view of a clip-support forming intermediate element between the barrel of the mechanical pencil and the eraser support;

FIG. 7B is a transverse section view of the intermediate element from FIG. 7A.

DESCRIPTION OF PREFERRED EMBODIMENTS OF THE INVENTION

Figure 3:
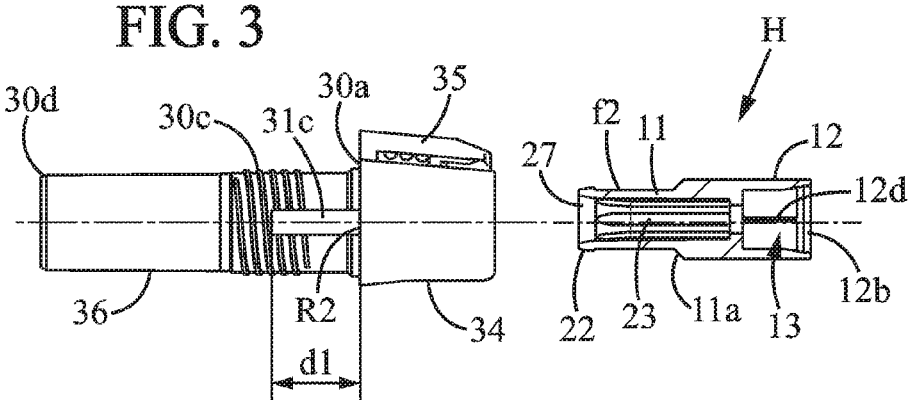
FIG. 3 is a side view illustrating two elements in the mechanical pencil from FIG. 1.

In the various figures, identical references denote identical or similar elements.

With reference in particular to FIGS. 1 and 2, the mechanical pencil 1 comprises a tubular body 2 which extends along a longitudinal axis X between a rear-end 2*a* and a front-end 2*b*. The front-end 2*b* of the tubular body 2 is defined by a point 3. A bore 3*a* and an opening 3*b* are provided in the point 3 to allow the sliding of a lead-support point 4. In a well-known manner, the lead-support point 4 accompanies the exiting pencil lead 5 to avoid breakage of the pencil lead 5.

A pushing device 6 is mounted through a first opening 7 formed in the rear-end 2*a* of the tubular body 2. The pushing device 6 has an actuating surface 6*a* oriented axially towards the outside. This pushing device 6 is mounted so as to slide parallel to the longitudinal axis X between a depressed position for actuating advancing the pencil lead 5 and a withdrawn position taken by default under the force of a spring 8 analogous elastic restoring means. FIGS. 1 and 2 show the mechanical pencil 1 in a configuration for use, with the pushing device 6 in the withdrawn position thereof.

Figure 4:
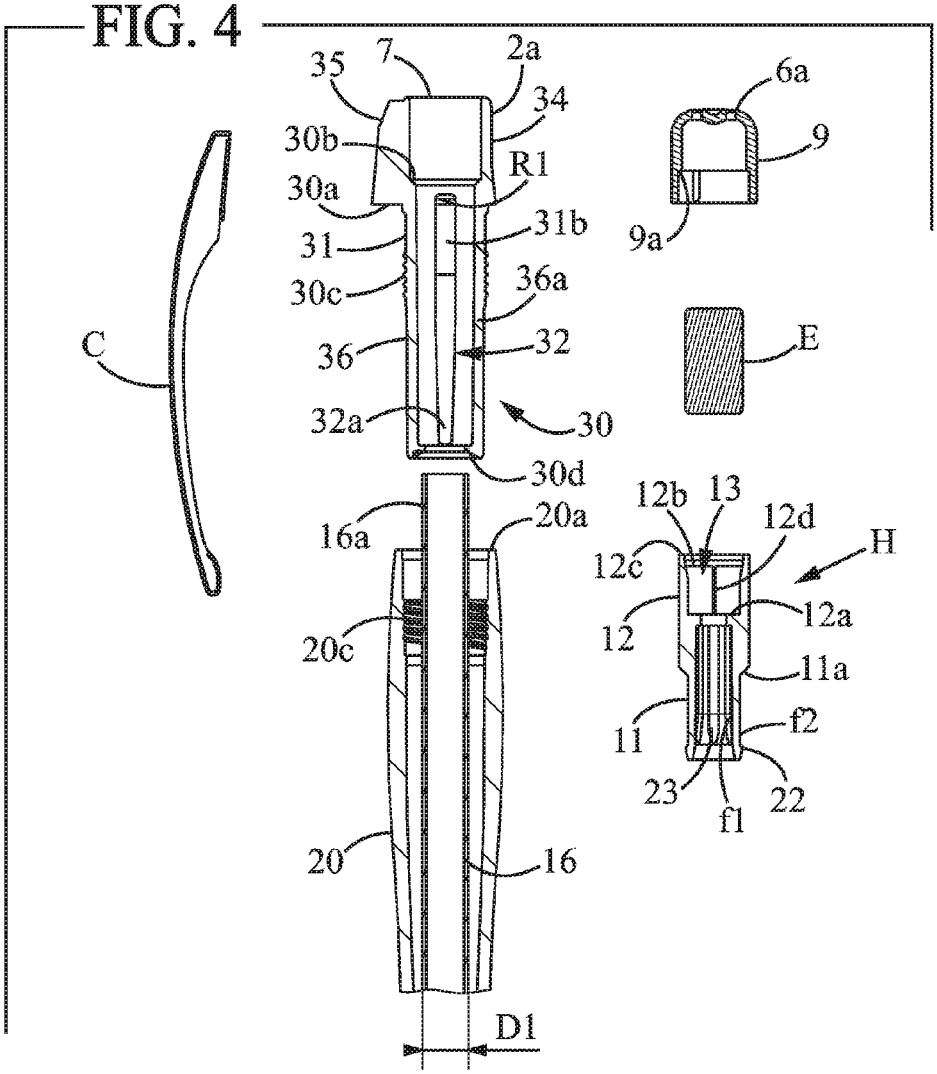
FIG. 4 is an exploded view along a longitudinal section showing elements already shown in FIG. 1.

As can be clearly seen in FIG. 1 and FIG. 4, the pushing device 6 includes the eraser E, an eraser support H made from one piece for housing the eraser E and a cap 9 for covering the eraser E. The eraser support H includes an internal portion 11 which is inserted into the tubular body 2 through the first opening 7 and which is in contact with tubular body 2 for guiding the pushing device 6. The eraser support H also includes a mounting member 12 which extends the inner portion 11 and which has a wall extending substantially annularly around the longitudinal axis X from the bottom 12*a* to a rear opening 12*b* so as to define a cavity 13 for housing the eraser H. This mounting member 12 is part of the outer portion of the eraser support H.

The outer portion 10 of the pushing device 6, which here includes the cap 9, the eraser E and the outer portion of the eraser support H, forms an actuating button for the pencil lead 5 advancing mechanism 15.

With reference to FIGS. 1 and 2, the pencil lead 5 advancing mechanism is here arranged in the tubular body 2 and includes:

- the pushing device 6 which slides parallel to the longitudinal axis X;
- a reservoir 16 for storing one or more pencil leads, which has a tubular shape and extends around the longitudinal axis X;
- a chuck 17 which can be tightened on the pencil lead 5 in a tightened position and located on the side of the front-end 2*b* of the tubular body 2, where the chuck 17 here comprises a tubular portion and a head 17*a* with a well-known configuration;
- a tightening member 18 which has a tightening ring 18*a* for immobilizing the pencil lead 5, with a tightening member 18 here encircling the chuck 17 in a well-known manner;
- the spring 8 which is in the compressed state (helicoidal type compression spring) and extends between a rear-end 8*a* supported against the reservoir 16 and a front end 8*b* supported against an internal shoulder of the tightening member 18.

As can be clearly seen in FIGS. 1 and 2, the reservoir 16 thus extends between the pushing device 6 and the spring 8. This reservoir 16 is typically cylindrical and arranged coaxially in the tubular body 2 The rear-end 16*a* of the reservoir 16 is surrounded by the inner portion 11 of the pushing device 6. It is understood that this inner portion 11 provides a support function for the reservoir 16 (by blocking the possibility of relative axial movement between the pushing device 6 and the reservoir 16). The front-end 16*b* thereof is fixed to the tubular portion of the chuck 17 and serves to move this chuck 17 into the tightened position when the pushing device 6 slides towards the front end. The inner stop B formed at the front-end 2*b* of the tubular body 2 serves to selectively stop the advance of the tightening member, such that the chuck 17 can continue to advance while reducing the tightening on the pencil lead 5 in a well-known manner. Since the spring 8 exerts an elastic restoring force in response to the pressure exerted on the pushing device 6 and the reservoir 16, the chuck 17 returns to the initial position thereof visible in FIG. 2 and the pencil lead 5 is again held tight.

Still in reference to FIG. 2, an additional spring 19 for damping the writing pressure can also be provided between the tightening member 18 and a covering tube 21 arranged around the reservoir 16 and which is translationally set in the barrel 20 of the tubular body 2.

The kinematics of the advancing mechanism 15 in the area of the front end of the mechanical pencil will not be further described because the invention instead concerns the integration of the pushing device 6 at the rear end of the tubular body 2.

With reference to FIGS. 1, 3-4 and 5A, it can be seen that the outer part of the eraser support H is particularly compact and has no outer shoulder or throat. In the withdrawn position taken by the pushing device 6, about 60-65% of the length of the eraser support H is located inside the tubular body 2, which makes the erasing operation easier when the mechanical pencil is grasped in the area of the rear end 2*a*.

Figure 5A:
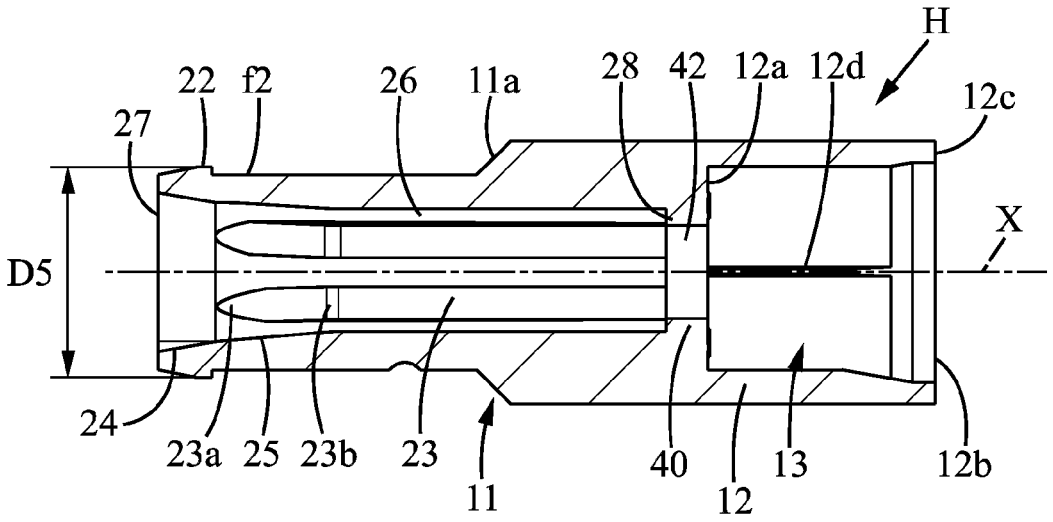
FIG. 5A is a longitudinal section view of an eraser support forming part of a pushing device used in the mechanical pencil from FIG. 1.

With reference to FIGS. 4 and 5A, the inner portion 11 of the pushing device 6, formed by the front of the eraser support H, comprises a tubular wall whose inner surface f1 serves as tightened attachment (attachment with friction) of the rear end 16*a* of the reservoir 16, and provided with an outer surface f2 on which at least one projection 22 projects radially outward. This projection 22 is here an annular rib which extends continuously on the circumference of the tubular wall of the inner portion 11. The rib has on the rear a surface which is preferably substantially planar and perpendicular to the longitudinal axis X. This annular rib, here cylindrical, has no slit (full rib) and is therefore radially indeformable and very inflexible. The eraser support H is made of plastic allowing for injection molding and serving to slightly compress the inner portion 11 during assembly.

In the inner portion 11, longitudinal ribs 23 are provided, formed on the inner surface f1 of the tubular wall for frictional contact with the rear end 16*a* of the reservoir 16. Each of these ribs 23 has a front end 23*a* which is beveled and tapered (the grooves formed between the ribs expand towards the front). Two successive slopes can be formed on the inner surface f1: a first slope 24, more steep, which extends to the front end of the inner portion 11 and a second slope 25, less steep, defined by the front end 23*a* of the ribs 23 which extends here between the projection 22 and the transition zone 23*b* of the ribs 23. Thus, the cavity 26 delimited by the tubular wall expands near the axial opening 27. In the eraser support H, it is understood that the cavity 26 extends axially forward from a bottom forming surface 28 of the mounting member 12 to the axial opening 27. The rear end 16*a* of the reservoir 16, pressed down into the cavity 26 to the bottom 28 and tightened here over more than half of the length of the inner portion 11 is thus visible on top in the area of the first opening 7.

In reference at present to FIGS. 1, 3, 4, 6 and 7A-7B, it can be seen that the rear and 2*a* of the tubular body 2 is formed by a clip support 30 which extends the barrel 20. The clip support 30 includes an outer shoulder 30*a* in contact with the rear edge 20*a* formed at the rear end of the tubular barrel 20. This single piece type clip support 30 can be longer than the pushing device 6 but has a length much less than the length of the barrel 20 and slightly less than the length of the clip C. The clip support 30 includes an annular wall 31 for retention of the pushing device 6. In less preferred variants, a part without single piece clip which serves for mounting the pushing device 6 can be substituted for the clip 30.

As can be clearly seen in FIG. 1 and FIG. 4, the clip support 30 is mounted onto the barrel 20 by screwing or other attachment means, such that the pushing device 6 can be separated from the barrel 20 during withdrawal of this clip support 30. In the screwed configuration of the clip support 30, it is fixed relative to the barrel 20 (with contact between the shoulder 30*a* and the rim 20*a* of the barrel) and defines the rear end 2*a* of the tubular body 2 of the mechanical pencil 1. In the example shown, the annular wall 31 for retention of the pushing device 6 allows the eraser support H to slide between a withdrawn position visible in FIG. 1 and a forward position actuating the advancing of the pencil lead 5, in which the inner portion 11 of the eraser support H comes to a stop against an internal shoulder 30*b* of the clip support 30. This internal shoulder 30*b* can possibly form a stop edge for frontward sliding of the pushing device 6 by engaging with the outer shoulder 11 a formed on the outer surface f2 of the tubular wall of the eraser support H. The threading 30*c* of the clip support 30—here a male threading which engages with the female threading 20*c* formed in the barrel 20—is made more forward than the shoulders 30*a* and 30*b* but away from the terminal portion 30*d*.

With reference to FIGS. 3 to 6, the withdrawn position of the eraser support H is reached when the projection 22, here with annular shape, comes to stop against the forward tabs R1, R2 integrally formed with the annular retaining wall 31 near the internal shoulder 30*b*. Them front surface S1, S2 of the tabs R1, R2 is preferably flat and perpendicular to the longitudinal axis X. As is clearly visible in FIG. 6, two slits 31*b*, 31*c* are formed on the inner surface 31*a* of the annular retaining wall 31. More particularly, these slits 31*b*, 31*c* are made through ribs 32, 33 opening radially inward serving for latching the annular projection 22. The respective rear end of each of the ribs 32, 33 forms a tab R1 or R2 which blocks rearward sliding of the pushing device 6 while thus keeping the spring 8 (visible in FIG. 2) in the compressed state. It is understood that each of the slits 31*b*, 31*c* here has a width equal to the width of the tabs R1, R2 (for example a width of order 2 mm). Each of the two ribs 32, 33 extend substantially parallel to the longitudinal axis X from the associated tab R1 or R2 to a front end 32*a*, 33*a*. The tabs R1 and R2 are arranged in a single circumferential area (at a single axial distance from the inner shoulder 30*b*) and are preferably diametrically opposed.

The slits 31*b*, 31*c* here have a rectangular format (with a constant width less than the outer diameter D1 of the reservoir 16, for example about 2 mm) and each have a length greater than the translational travel of the eraser support H between the most forward position thereof and the withdrawn position. Each of the tabs R1, R2 delimits a rear edge of the slits 31*b*, 31*c* and projects radially inward relative to the remainder of the inner surface 31) of the annular portion 31. In other words, each of these tabs R1, R2 is as narrow as the associated respective slit 31*b* or 31*c* so as to make it easier to latch the pushing device 6 and the tubular body 2. In implementation variants, wider longitudinal openings could be provided.

With reference to FIGS. 1, 3 and 6, the slits 31*b*, 31*c* extend longitudinally a distance d1 which is greater than the distance d between the inner shoulder 30*b* of the clip support and the outer shoulder 11*a* formed on the tubular wall of the pushing device 6. With this configuration, the axially discontinuous ribs 32, 33 do not serve to block the forward sliding of the pushing device 6, since only the rearward sliding is stopped during contact of the annular projection 22 against the stops R1, R2 formed at the rear of the ribs 32, 33 to enable the retention of the pushing device 6 inside the tubular body 2.

With reference to FIGS. 1-2 and 6 to 7B, it should be noted that retaining the pushing device 6 of the advancing mechanism 15 inside the tubular body 2 is made possible by the clip support 30 simply because of the engagement between the projection 22 which slides along the slits 31*b*, 31*c* and the two rigid tabs R1, R2 formed on the inner surface 31*a* of the annular retention wall 31. The projection 22, preferably made in the form of a latching rib, has a very low height, of order 0.2 mm (radial height measured relative to the substantially cylindrical surface of the face f2 opposite tabs R1, R2 during sliding), and more generally less than 0.6 mm in order to be able to pass over the two retention tabs R1, R2 during assembly of the eraser support H. This height remains sufficient for stopping against these tabs R1, R2 on rearward movement so that the eraser support H cannot be withdrawn from the clip support 30.

In FIG. 5A, it can be seen that the outer diameter D5 defined by the projection 22 remains much less than the larger diameter of the eraser support H which substantially corresponds to the diameter D7 (FIG. 7A) formed in the rear opening of the axial passage of the clip support 30. In turn, this diameter D5 is slightly greater than the separation distance L5 (FIG. 7B) between the two tabs R1, R2 providing retention. As an example, the difference between these two dimensions is less than or equal to 0.5 mm.

In a preferred embodiment and as shown on FIGS. 3-4, 6 and 7B, the slits 31*b*, 31*c* and the annular retention wall 31 form windows for the clip support 30 located more forward than the external shoulder 30*a*. This external shoulder 30*a* is furthermore closer to the windows than the internal shoulder 30*b* which is placed farther back. The clip support 30 provided with windows could be easier to obtain during injection molding, considering the interference of the slits 31*b*, 31*c* with the ribs 32, 33. It should also be noted that the windows which extend from the outer shoulder 30*a* are sufficiently long to interfere with the outer threading 30*c* of the clip support 30 (the corresponding thread being bent), as is clearly visible on FIG. 3 and FIG. 6. The positioning of this outer threading 30*c* is relatively close to the outer shoulder 30*a* in order that the screwing be made easier.

With reference to FIGS. 4 and 6-7B, the clip support 30 can have a generally tubular shape with:

- a rear segment 34 placed in the axial extension of the barrel 20 and including an attachment socket 35 in order to mount the clip C in a well-known manner; and
- a forward segment 36 of generally tubular shape extending around the longitudinal axis X and which is inserted coaxially into the barrel 20.

The forward segment 36 of the clip support 30 includes a tubular portion 36*a* for attachment to the barrel 20 including the external threading 30*c* and extending around and away from the reservoir 16. The terminal portion 30*d*, with generally annular shape, is placed in the extension of the tubular attachment portion 36*a*. The terminal portion 30*d* has an annular rim in contact with a covering tube 21 arranged around the reservoir 16 and an axial orifice 37 with the circular section reduced compared to the passage section defined by the tubular attachment portion 36*a*. As an example, the axial orifice 37 has an inner diameter D2 at least 30% less than the inner diameter D7 of the first opening 7. Thus, the clip support 30 serves to significantly vary the section for passage between the front for the passage of the narrow reservoir 16 (of diameter D1 slightly less than diameter D2) and the rear for the passage of a much larger eraser support H.

With reference to FIGS. 5A and 6 to 7B, the annular retention wall 31 is for example arranged in a junction zone between the rear segment 34 and the front segment 36 or extends on both sides of the outer shoulder 30*a*. Thus, the tabs R1, R2 can be located in the rear segment 34 whereas the slits 31*b*, 31*c* are located in the front segment 36. With this localization, the eraser support H can slide both against an inner surface 34*a* of the rear segment 34 (by means of the largest part of the eraser support H) and against another inner surface formed on the annular retention wall 31 (by means of the annular projection 22), which improves the translational guiding along the longitudinal axis X.

In the example from FIGS. 4, 6 and 7A, it can be seen that the ribs 32, 33 have their front ends 32*a*, 33*a* adjacent to the terminal portion 30*d* of the clip support 30, such that they significantly stiffen the front segment 36 of the clip support 30.

Figure 5B:
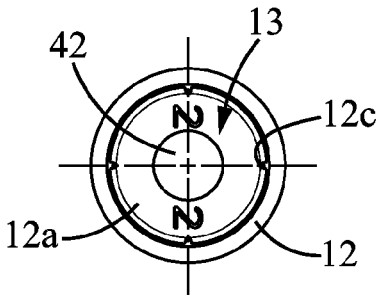
FIG. 5B is a top view of the eraser support from FIG. 5A.

In the embodiment from FIGS. 1, 5A and 5B, it can be seen that the eraser support H comprises a transverse wall 40 which defines on one side (front) the bottom 28 of the cavity 26 and on another side (rear) the bottom 12*a* of the cavity 13 for housing the eraser E. An axial passage orifice 42 is formed, preferably centrally, in the transverse wall 40 in order to provide access to the reservoir 16 from the outside of the tubular body 2 and insert pencil lead into it. Here the passage orifice 42 opens directly into the reservoir 16.

With reference to FIG. 1, it can be seen that the eraser E is kept entirely outside of the inner volume defined by the tubular body 2 in the resting position, when withdrawn. The spring 8 urges rearward the pushing device 6 which comes to engage in the area of projection 22 on the surfaces S1, S2 of the tabs R1, R2 to achieve this resting position. In this resting position, meaning outside of any actuation on the pushing device 6, the pencil lead 5 is kept locked.

With reference to FIGS. 1, 4 and 6, the cap 9 can then receive the eraser E of elastomer and an inner shoulder 9*a* formed on the inner surface of the cap 9 comes, for example, to engage against the annular rim 12*c* of the eraser support H. This annular rim 12*c* here surrounds the opening 12*b* of the mounting member 12.

The eraser E is kept locked in the cavity 13 of the assembly member 12 in a well-known manner, for example by means of internal ribs 12*d* which are extended in a direction parallel to the longitudinal axis X from the bottom 12*a* up to near the opening 12*b*. One or more inner ribs can be made on a lateral surface of the cap 9 to produce gripping on the eraser E.

With reference to FIG. 1, by exerting pressure on the actuating surface 6*a* of the pushing device 6, a forward movement of the pushing device 6 results over a distance which can be equal to the distance d or slightly less. A rear surface 4*a* of the lead-support point 4 can for example form an axial stop which serves to stop the advance of the head 17*a* of the chuck 17, which is seen as the stoppage of forward sliding of the pushing device 6. At the end of forward sliding, the shoulder 11*a* is located near the inner shoulder 30*b* and is located nearly resting thereon. The shoulders 11*a* and 30*b* can supplement or complement the forward sliding stop system.

As the assembly formed of the reservoir 16 and chuck 17 advances identically with the pushing device 6, the pencil lead 5 can also advance some distance relative to the point 3 of the tubular body 2 and to the lead-support point 4 (where said lead-support point remains immobile in the bore 3*a* of the point 3 because of a larger associated frictional force than the frictional force between the lead-support point 4 and the pencil lead 5). The forward distance of the pencil lead is however less than the distance d because of the loosening of the head 17*a* of the chuck which occurs at about the middle of the forward travel of the chuck 17 because of the forward offset relative to the tightening member 18. The frictional force between the pencil holder point 4 and the pencil lead 5 is then sufficient to keep the lead-support point 5 in position during the end of advancing of the advancing device 6 with which are associated the reservoir 16 and the chuck 17.

If the user releases the pressure on the pushing device 6, the spring 8 pushes the reservoir 16, chuck 17 and pushing device 6 back rearward. Since the head 17*a* of the chuck 17 remains open over nearly the entire length of this return movement (since the head 17*a* is then in an un-tightened configuration relative to the pencil lead 5), the pencil lead 5 makes only a very small return movement. At the end of this rearward movement, the advance mechanism 15 assembly returns to resting position, as shown in FIG. 1, and the head 17*a* of the chuck 17 is again immobilized on the pencil lead 5.

When the user wants to use the mechanical pencil 1 to erase, the user grasps a relatively large grip 45 formed by the clip support 30. As can be seen on FIGS. 7A and 7B, the outer diameter D3 of the clip support 30 can represent more than twice the inner diameter D2 formed of the terminal portion side 30*d*, where this sizing serves to apply a greater grasping force which can be useful for doing generally more effective energetic erasing. Furthermore, the proximity of the grip 45 to the eraser E also makes erasing easier. As a nonlimiting example, the diameter D4 of the rear of the front segment 34 of the clip support 30 can be of order 10 mm and the diameter D3 can be slightly less than the diameter D4, for example of order 9 mm. Such a dimension is advantageous for the effectiveness of erasing compared to conventional mechanical pencils where the diameter at the rear of the tubular body is only 6 mm. Additionally, this arrangement does not prevent using a standard format eraser E with a diameter of about 6 mm.

An advantage of the invention resides in the robustness and ergonomics of the rear portion of the mechanical pencil 1, with the possibility for example of positioning the eraser E closer to the rear end 2*a* of the tubular body 2.

It is understood that each of the examples and each of the implementation details previously described can be used in isolation or in combination.

Furthermore, it is understood that the parts forming the clip support 30 and the eraser support H can have a different external appearance according to the desired application. Thus the mounting member 12 could possibly be eliminated, the clip C could be mounted differently and/or the clip support 30 could be replaced by an intermediate element without a clip between the pushing device 6 and the barrel 20. It must therefore be obvious for people versed in the art that the present invention provides embodiments in many other specific forms without departing from the domain of application of the invention as claimed.

The invention claimed is:

1. A mechanical pencil comprising a tubular body extending along a longitudinal axis between a rear end which has a first opening and a front end which has a second opening, a lead that can move out through the second opening and a mechanism for advancing the lead arranged within the tubular body, wherein the advancing mechanism comprises:

a pushing device adapted to slide parallel to the longitudinal axis, comprising an external portion that extends outward relative to the tubular body and an inner portion inserted into the tubular body through the first opening;

a chuck located at the front end side of the tubular body and which could be tightened onto the lead in a tightened position;

a reservoir which extends along the longitudinal axis for housing at least one lead, wherein the reservoir comprises a rear end surrounded by the inner portion of the pushing device and a front end suited for moving the chuck when the pushing device slides towards the front end;

wherein the tubular body has an annular wall for a pushing device retention at the rear end thereof, the annular wall comprising on an inner surface two longitudinal recesses which include two slits, each longitudinal recess having a rear edge delimited by a tab projecting radially inward relative to the remainder of the inner surface of the annular portion, wherein the inner portion of the pushing device comprises a tubular wall having:

an inner surface providing an attachment of the rear end of the reservoir; and an outer surface on which at least one projection projects radially outward, the projection being located in front of the tabs towards the second opening and suited for stopping against the tabs, wherein the inner portion of the pushing device is retained inside the tubular body.

2. The mechanical pencil according to claim 1, wherein the longitudinal recesses include two diametrically opposed slits where at least one of the two slits opens radially inward through a rib whose rear end is defined by one of the tabs and where the rib extends substantially parallel to the longitudinal axis from the tab to a front end.

3. The mechanical pencil according to claim 1, wherein the pushing device comprises an eraser support made of one piece for housing an eraser where the eraser support comprises:

the inner portion;

a mounting member comprising a bottom and a wall extending annularly around the longitudinal axis from the bottom to a rear opening so as to define a cavity for housing the eraser, the mounting member extending the inner portion and making part of the outer portion;

a passage orifice traversing the bottom of the mounting member and opening directly into the reservoir.

4. The mechanical pencil according to claim 3, wherein the tubular wall of the inner portion has an axial opening opposite the bottom of the mounting member and delimits a cavity for receiving the rear end of the reservoir between the bottom and the axial opening, wherein the cavity widens near the axial opening.

5. The mechanical pencil according to claim 1, wherein the projection is an annular rib which extends continuously on the circumference of the tubular wall of the inner portion.

6. The mechanical pencil according to claim 1, wherein the tubular body comprises:

a tubular barrel extending longitudinally around the longitudinal axis and having a length much greater than the length of the pushing device; and a removable clip support arranged as a longitudinal extension of the barrel and comprising the annular retaining wall including the tabs, the pushing device being slidably mounted in the clip support which forms the rear end of the tubular body.

7. The mechanical pencil according to claim 6, wherein the clip support comprises:

a rear segment arranged in the axial extension of the barrel and suited for receiving a clip; and a front segment of generally tubular shape extending around the longitudinal axis and which is inserted coaxially into the barrel the front segment comprising a tubular portion for attachment to the barrel provided with an external threading and extending around and away from the reservoir.

8. The mechanical pencil according to claim 7, wherein the front segment further comprises a terminal portion having a general annular shape arranged in the extension of the tubular attachment portion, wherein the terminal portion has an annular edge in contact with a covering tube arranged around the reservoir and an axial orifice having an inner diameter at least 30% less than an inner diameter of the first opening.

9. The mechanical pencil according to claim 6, wherein the clip support comprises an outer shoulder in contact with a rear edge of the barrel and an inner shoulder which is axially across from an outer shoulder formed on the tubular wall of the pushing device.

10. The mechanical pencil according to claim 9, wherein the two longitudinal recesses extend longitudinally over a distance which is greater than the distance between the inner shoulder of the clip support and the outer shoulder formed on the tubular wall of the pushing device, wherein the two longitudinal recesses form windows for the clip support.

* * * * *